US005556144A

United States Patent [19]

Lin

[11] Patent Number: 5,556,144

[45] Date of Patent: Sep. 17, 1996

[54] AUXILIARY DOOR LATCH HAVING A LOCKING DEVICE

[75] Inventor: Jui-Chang Lin, Kaohsiung Hsien, Taiwan

[73] Assignee: Taiwan Fu Hsing Industrial Co., Ltd., Kaohsiung Hsien, Taiwan

[21] Appl. No.: 267,357

[22] Filed: Jun. 29, 1994

[51] Int. Cl.[6] ..... E05B 3/00

[52] U.S. Cl. ..... 292/336.3; 292/348; 70/224; 70/479; 70/223

[58] Field of Search ..... 292/336.3, 169.13, 292/169.14, 347, 348, 356, 357; 70/218, 220, 222–224, 367–371, 472, 479, 481, 448–452, 379–381, DIG. 31

[56] References Cited

U.S. PATENT DOCUMENTS

| | | | |
|---|---|---|---|
| 1,899,997 | 3/1933 | Sullivan | 70/222 |
| 1,992,126 | 2/1935 | Hurd | 70/DIG. 31 X |
| 2,497,328 | 2/1950 | Smith et al. | 70/223 X |
| 2,743,123 | 4/1956 | Alexander | 292/347 X |
| 3,075,797 | 1/1963 | Patriquin et al. | 292/356 X |
| 3,427,061 | 2/1969 | McMeen et al. | 292/357 X |
| 4,852,922 | 8/1989 | Shih | 292/336.3 |
| 5,010,752 | 4/1991 | Lin | 70/472 X |
| 5,040,391 | 8/1991 | Lin | 70/279 X |
| 5,177,987 | 1/1993 | Shen | 70/479 X |
| 5,190,327 | 3/1993 | Lin | 292/348 |

*Primary Examiner*—Steven N. Meyers
*Assistant Examiner*—Suzanne L. Dino
*Attorney, Agent, or Firm*—Jacobson, Price, Holman & Stern, PLLC

[57] ABSTRACT

An auxiliary door latch includes a lock device for locking the auxiliary door latch from inside of the door panel so as to prevent the door panel from opening from outside of the door panel. The auxiliary door latch includes a knob having a tube extended inwards of the door panel, and a rod slidably engaged in the tube and having a pair of legs. The tube includes a pair of slots for engaging with the legs of the rod. The rod is depressed inwards of the knob so as to prevent the rod from rotational movement and so as to lock the auxiliary door latch.

3 Claims, 5 Drawing Sheets

AUXILIARY DOOR LATCH HAVING A LOCKING DEVICE

BACKGROUND OF THE INVENTION

1. Field of the Invention

The present invention relates to an auxiliary door latch, and more particularly to an auxiliary door latch having a locking device.

2. Description of the Prior Art

Typical door latches comprise an inside knob and an outside knob, the door may be opened with both of the knobs. For safety purposes, a so-called "auxiliary door latch" or "auxiliary lock" 0 is further provided for controlling the door panel. The auxiliary door latch also includes an inside knob and an outside knob. The door panel can be easily opened by the inside knob without key means, and can not be opened with the outside knob except when a key means is engaged in the outside knob. However, the auxiliary door latch can not be locked, such that the door panel may also be easily opened from outside of the door panel by unauthorized persons.

The present invention has arisen to mitigate and/or obviate the afore-described disadvantages of the conventional auxiliary door latches.

SUMMARY OF THE INVENTION

The primary objective of the present invention is to provide an auxiliary door latch which includes a locking device therein for locking the auxiliary door latch.

In accordance with one aspect of the invention, there is provided an auxiliary door latch comprising a base plate for securing to a door panel, a spindle extended through the base plate for engaging with and for actuating a latch bolt, a board secured to the base plate and including an aperture formed therein, at least one cavity formed beside the aperture, a knob including a tube extended through the board and extended toward the base plate, the tube including at least one slot formed therein, the slot including a depression formed therein distal to the base plate, a rod slidably engaged in the tube and including a first end having a channel formed therein for slidably engaging with the spindle and arranged such that the spindle and the rod rotate in concert, the rod including a second end extendible outward of the knob, at least one leg extended from the rod for engaging with the slot and the depression of the tube, the leg being rotated to align with the cavity of the board when the knob is rotated, means for biasing the leg to move away from the base plate, the leg being forced to engage with the cavity of the board against the biasing means so as to prevent the rod from rotating relative to the board; and means for catching the tube to the rod so as to prevent the rod from moving outward of the knob.

The catching means includes at least one indentation formed in the rod, a resilient member engaged on the tube and having a catch portion engaged in the slot of the tube for engaging with the indentation so as to retain the rod in place relative to the tube and so as to prevent the rod from extending outward of the knob.

The depression of the tube includes a size smaller than that of the slot of the tube, the knob is prevented from rotating relative to the rod when the leg is engaged in the depression, and the knob is rotatable relative to the rod when the leg is engaged in the slot.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
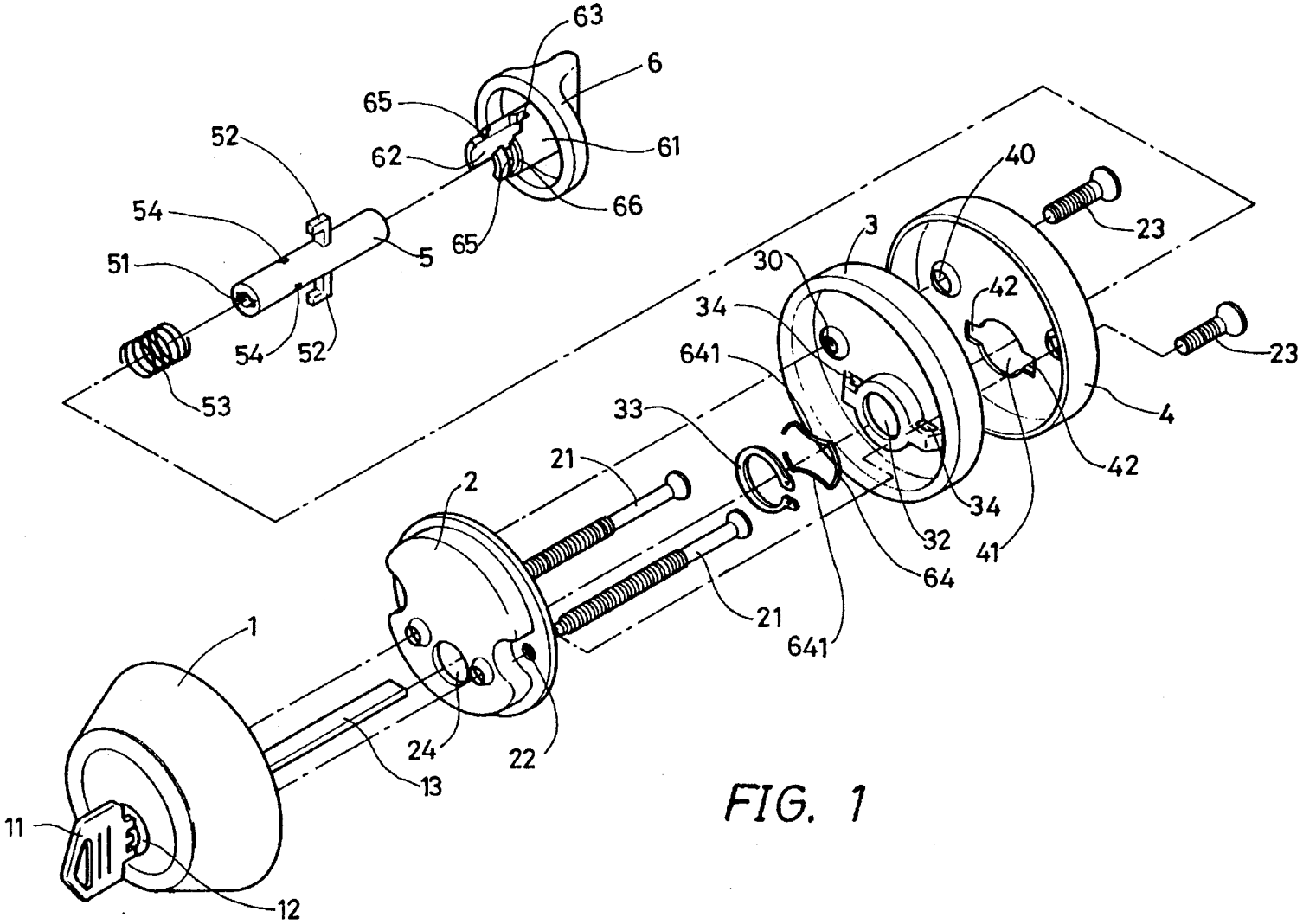
FIG. 1 is an exploded view of an auxiliary door latch in accordance with the present invention.
Figure 2:
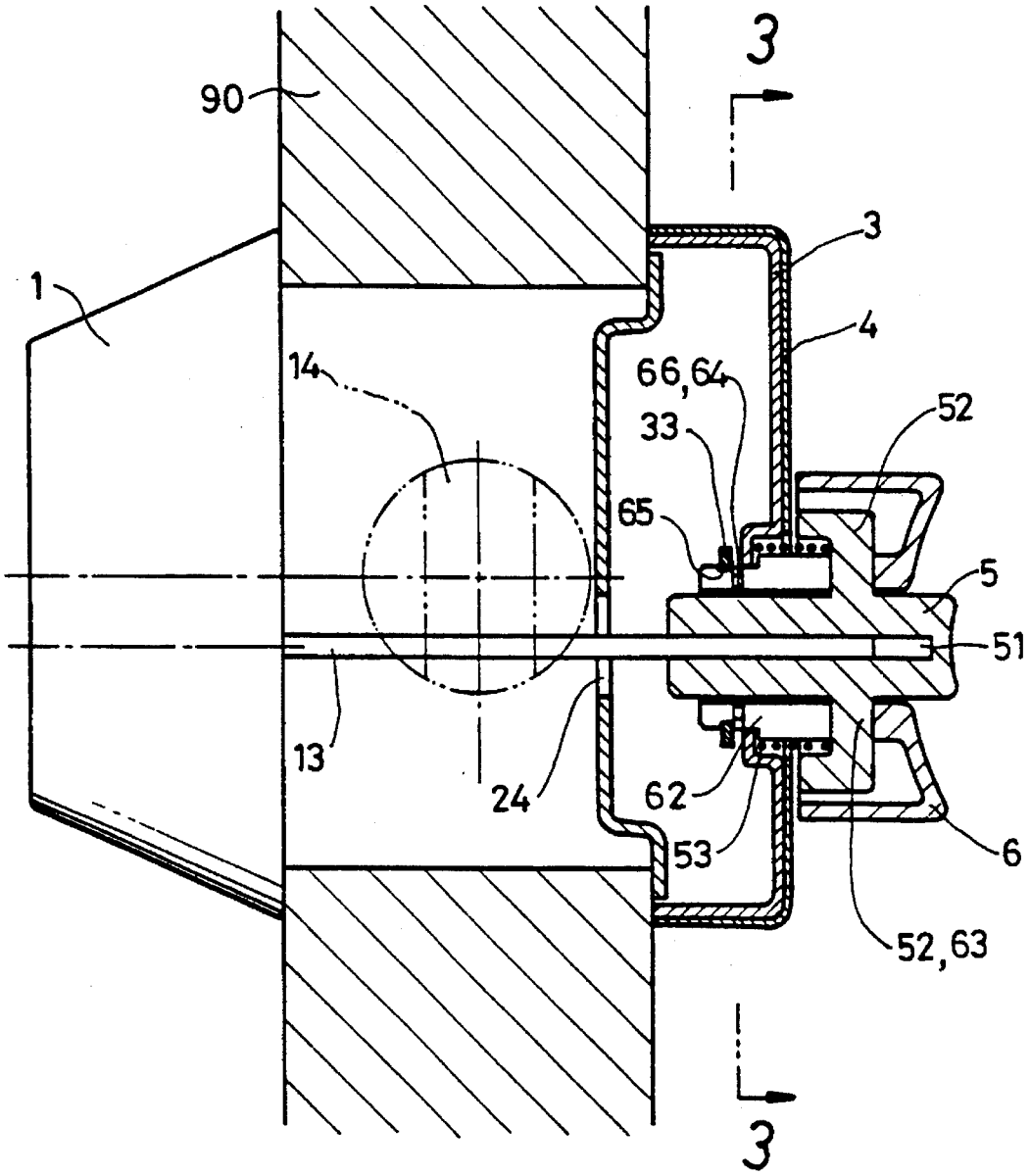
FIG. 2 is a cross sectional view taken along lines 2≦2 of FIG. 3.

Referring to the drawings, and initially to FIGS. 1 and 2, an auxiliary door latch in accordance with the present invention comprises a conventional outside cap 1 including a lock mechanism 12 disposed therein for engaging with a key 11 so as to actuate a spindle 13 in order to actuate a conventional latch bolt 14 (FIG. 2) which controls the door panel. A base plate 2 is engaged in the inside portion of the door panel 90, two screws 21 engage through the base plate 2 and engage with the outside cap 1 so as to fix the outside cap 1 and the base plate 2 to the door panel 90. The base plate 2 includes an opening 24 formed therein for engaging with the spindle 13 and includes two screw holes 22 formed therein.

A board 3 and an inside cap 4 are both engaged with the base plate 2 and each includes two holes 30, 40 formed therein for engaging with screws 23 which engage with the screw holes 22 of the base plate 2 so as to secure the board 3 and the inside cap 4 in place. The board 3 includes an aperture 32 formed therein and a pair of cavities 34 oppositely formed beside the aperture 32. The inside cap 4 includes an orifice 41 formed therein and two notches 42 oppositely formed in the orifice 41 and aligned with the cavities 34 of the board 3.

A knob 6 includes a tube 61 engaged through the orifice 41 of the inside cap 4 and the aperture 32 of the board 3. The tube 61 includes a pair of slots 62 oppositely formed therein and a pair of depressions 63 formed in the root portions of the slots 62. The depressions 63 have a smaller size than that of the slots 62. A retaining ring 33 is engaged with an annular groove 65 of the tube 61 so as to prevent the tube 61 from moving longitudinally such that the tube 61 is limited to rotational movement only. Another annular groove 66 is formed beside the groove 65 for engaging with a resilient member 64, the member 64 includes a pair of catch portions 641 engaged with the slots 62 such that the resilient member 64 rotates in concert with the knob 6. A rod 5 is slidably engaged in the tube 61 and includes a channel 51 formed in one end for engaging with the spindle 13 and includes another end extendible outward of the knob 6. The spindle 13 is slidable longitudinally within the channel 51 and arranged such that the rod 5 rotates in concert with the spindle 13. A pair of legs 52 are oppositely extended from the rod 5 for engaging with the slots 62 and the depressions 63 of the tube 61. The rod 5 further includes a pair of indentations 54 formed therein for engaging with the catch portions 641 of the resilient member 64 so as to prevent the rod 5 from moving longitudinally within the tube 61. A spring 53 is biased between the legs 52 and the board 3 for biasing the rod 5 outward of the knob 6 (FIG. 2).

Figure 3:
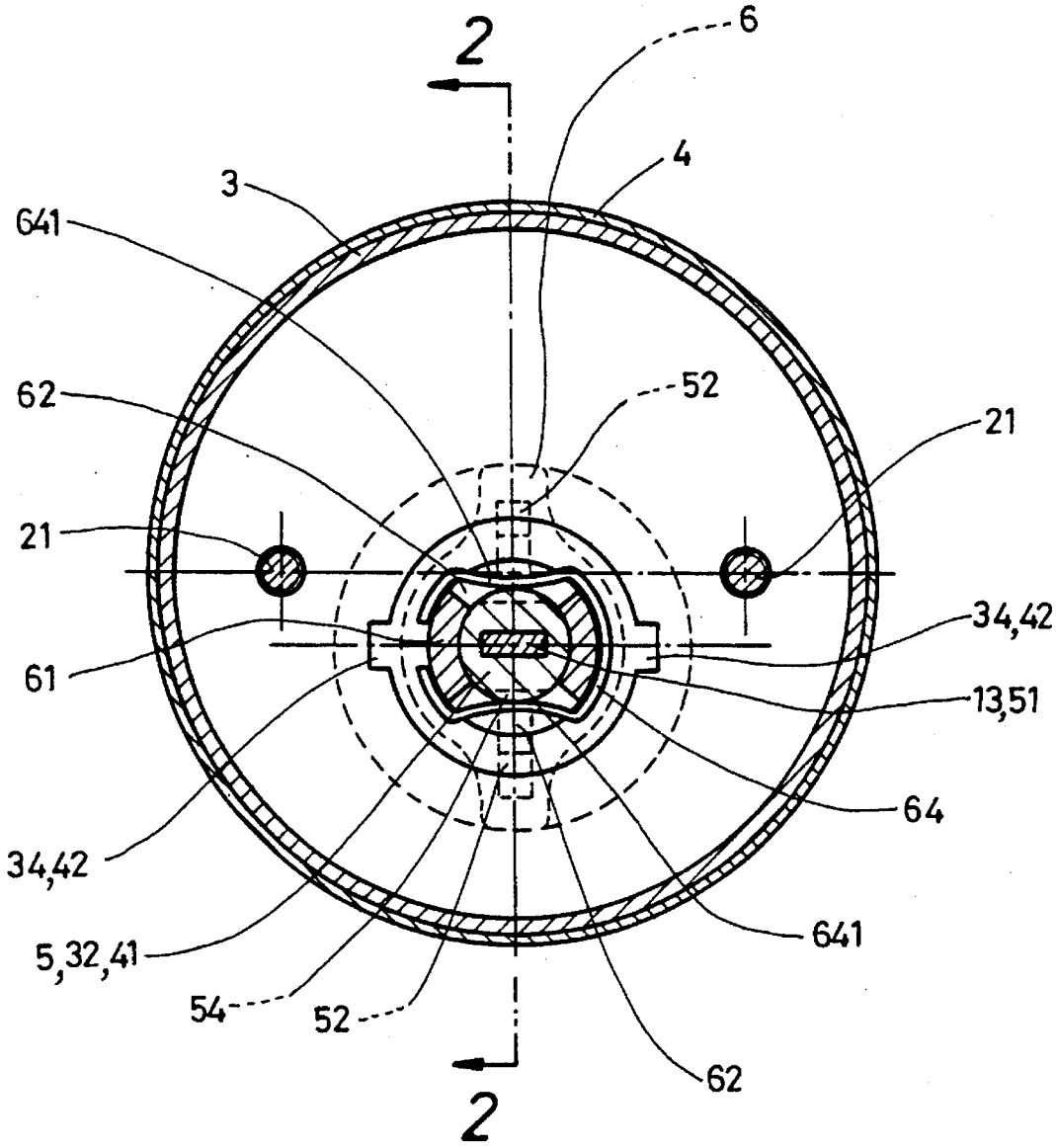
FIG. 3 is a cross sectional view taken along lines 3—3 of FIG. 2.

In operation, as shown in FIGS. 2 and 3, the legs 52 of the rod 5 are biased to engage within the depressions 63 of the tube 61 by the spring 53 and are disengaged from the cavities 34 and the notches 42 of the board 3 and the inside cap 4, such that, at this moment, the rod 5 may be rotated by the knob 6 in order to actuate the spindle 13 and in order to actuate the latch bolt 14. The auxiliary door latch is not locked at this moment. As shown in FIG. 3, the catch portions 641 of the member 64 are disengaged from the indentations 54 of the rod 5 such that the rod 5 may freely move longitudinally within the tube 61.

Figure 4:
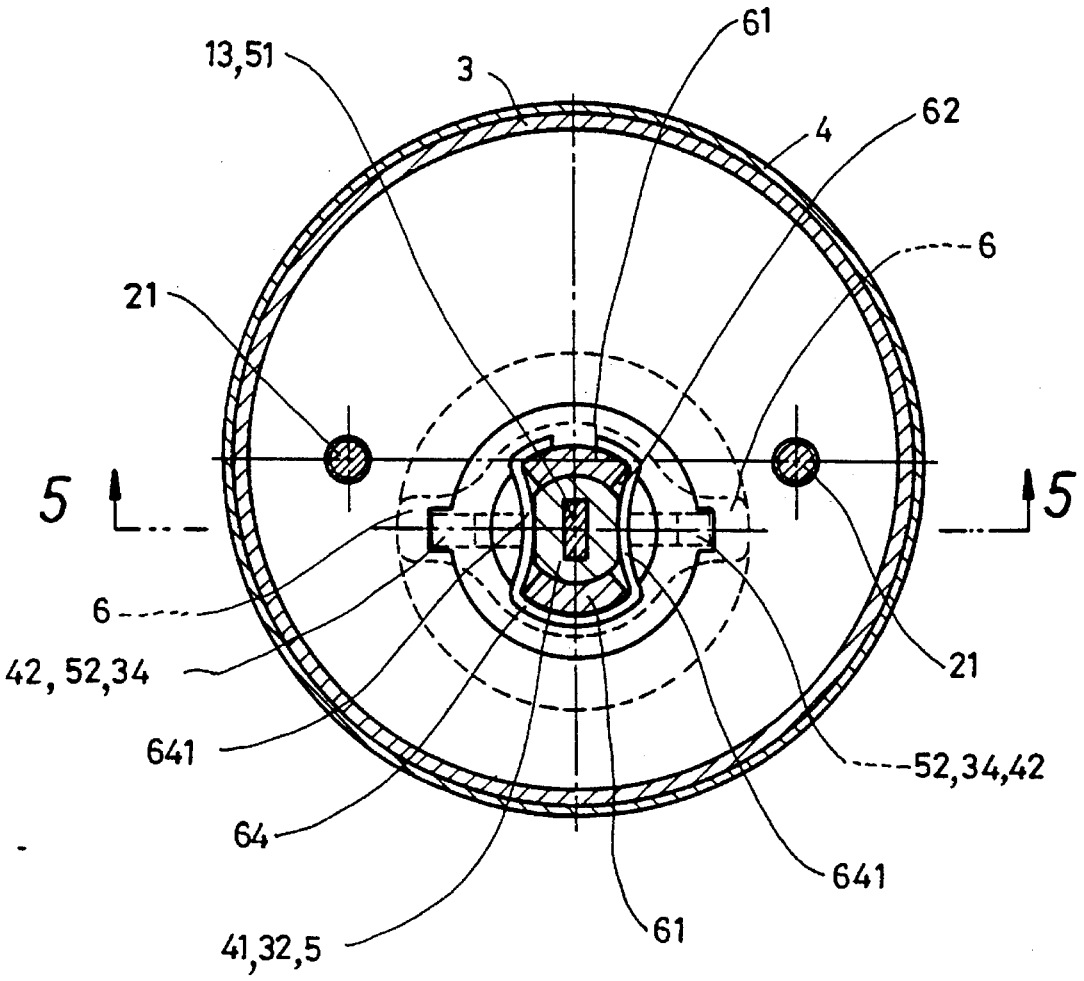
FIG. 4 is a cross sectional view similar to FIG. 3, and taken along lines 4—4 of FIG. 5, for illustrating the operation of the door latch.
Figure 5:
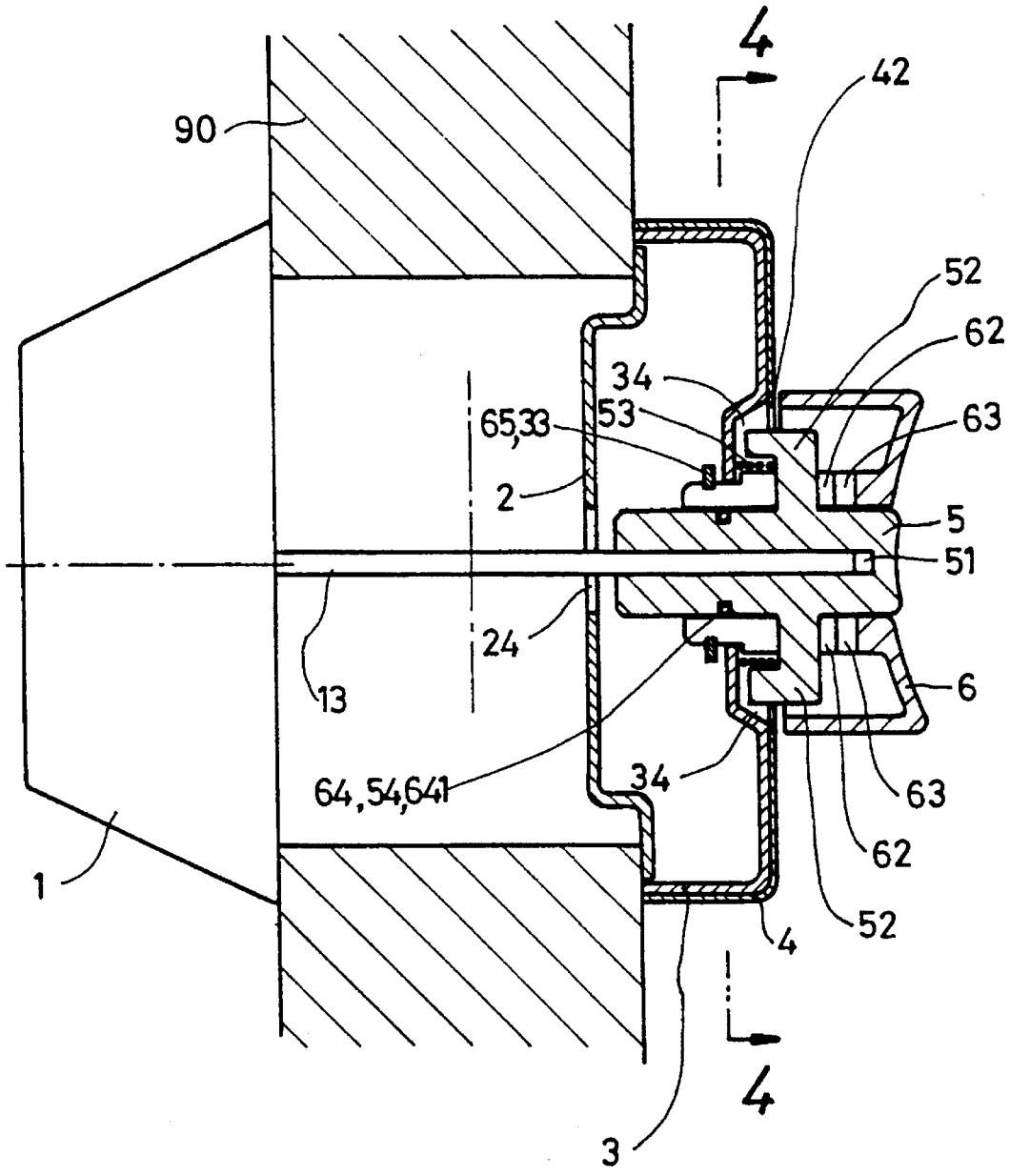
FIG. 5 is a cross sectional view taken along lines 5—5 of FIG. 4.

As shown in FIGS. 4 and 5, when the knob 6 is rotated for about 90 degrees, the legs 52 of the rod 5 may also be rotated to align with the cavities 34 and the notches 42 of the board 3 and the inside cap 4. At this moment, the rod 5 may be pressed inwards of the knob 6 against the spring 53 such that the legs 52 are engaged within the cavities 34 and the notches 42 of the board 3 and the inside cap 4, best shown in FIG. 5. The legs 52 and thus the rod 5 are prevented from rotating relative to the board 3 and the inside cap 4 such that the rod 5 may not be rotated by the spindle 13 and the outside cap 1. At this moment, the legs 52 are disengaged from the depressions 63 and are engaged in the slots 62 such that the knob 6 may further be rotated relative to the rod 5. When the catch portions 641 of the member 64 are aligned with and engaged with the indentations 54 of the rod 5, the rod 5 is retained in place and is prevented from moving outward of the knob 6.

When it is desired to unlock the auxiliary door latch, it is only required to rotate the knob 6 so as to disengage the catch portions 641 from the indentations 54. The rod 5 may be biased outward of the knob 6 again by the spring 53 such that the legs 52 are disengaged from the cavities 34 and the notches 42 of the board 3 and the inside cap 4. The spindle 13 can thus be rotated by the knob 6 via the rod 5.

Accordingly, the auxiliary door latch in accordance with the present invention includes a locking device for locking the auxiliary door latch.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An auxiliary door latch comprising:

a base plate for securing to a door panel;

a spindle extended through said base plate for engaging with and for actuating a latch bolt;

a board secured to said base plate and including an aperture formed therein, at least one cavity formed beside said aperture;

a rotatable knob including a tube extended through said board and extended toward said base plate, said tube including at least one slot formed therein, said slot including a depression formed therein distal to said base plate;

a rod axially slidably engaged in said tube and including a first end having a channel formed therein for slidably engaging with said spindle and arranged such that said spindle and said rod rotate in concert, said rod including a second end extending outward of said knob for moving the rod inwardly in said tube by depressing the second end of the rod, at least one leg extended radially from said rod for engaging with said slot and said depression of said tube, said leg being rotated to align with said cavity of said board when said knob is rotated;

means for biasing said leg away from said base plate, said leg being forced to engage with said cavity of said board against said biasing means when the rod is moved inwardly so as to prevent said rod from rotating relative to said board; and means for catching said tube to said rod so as to prevent said rod from moving outward of said knob.

2. An auxiliary door latch according to claim 1, wherein said catching means includes at least one indentation formed in said rod, a resilient member engaged on said tube and having a catch portion engaged in said slot of said tube for engaging with said indentation so as to retain said rod in place relative to said tube and so as to prevent said rod from moving outward of said knob.

3. An auxiliary door latch according to claim 1, wherein said depression of said tube is smaller radially than said slot of said tube, so that said knob is prevented from rotating relative to said rod when said leg is engaged in said depression, and said knob is rotatable relative to said rod when said leg is engaged in said slot.

* * * * *